US009916960B2

(12) United States Patent
Heid

(10) Patent No.: US 9,916,960 B2
(45) Date of Patent: Mar. 13, 2018

(54) DEVICE FOR PRODUCING AN ELECTRON BEAM

(71) Applicant: Oliver Heid, Erlangen (DE)

(72) Inventor: Oliver Heid, Erlangen (DE)

(73) Assignee: Siemens Aktiengesellschaft, München (DE)

( * ) Notice: Subject to any disclaimer, the term of this patent is extended or adjusted under 35 U.S.C. 154(b) by 0 days.

(21) Appl. No.: 14/976,439

(22) Filed: Dec. 21, 2015

(65) Prior Publication Data

US 2016/0181052 A1 Jun. 23, 2016

(30) Foreign Application Priority Data

Dec. 22, 2014 (DE) ..... 10 2014 226 812

(51) Int. Cl.
*H01J 1/16* (2006.01)
*H01J 35/06* (2006.01)
*H05G 2/00* (2006.01)

(52) U.S. Cl.
CPC ..... *H01J 35/06* (2013.01); *H01J 1/16* (2013.01); *H05G 2/005* (2013.01)

(58) Field of Classification Search
CPC .... H01J 29/46; H01J 1/16; H01J 35/06; H01J 35/065
USPC ..... 313/293
See application file for complete search history.

(56) References Cited

U.S. PATENT DOCUMENTS 5,191,217 A * 3/1993 Kane ..... H01J 3/022 250/423 F
5,543,691 A * 8/1996 Palevsky ..... H01J 31/127 313/309
5,773,921 A 6/1998 Keesmann et al.
5,834,781 A * 11/1998 Fukuhara ..... H01J 37/06 250/423 F
RE38,223 E 8/2003 Keesmann et al.
RE38,561 E 8/2004 Keesmann et al.
2004/0036402 A1 2/2004 Keesmann et al.
2011/0294071 A1 12/2011 Imaoka

FOREIGN PATENT DOCUMENTS

DE 4405768 A1 8/1995
EP 2390896 A1 11/2011
FR 2844916 A1 3/2004
WO WO2008/120341 A1 10/2008

OTHER PUBLICATIONS

German Search Report for related German Application No. 10 2014 226 812.5, dated Aug. 10, 2015, with English Translation.

* cited by examiner

*Primary Examiner* — Christopher Raabe
(74) *Attorney, Agent, or Firm* — Lempia Summerfield Katz LLC

(57) ABSTRACT

A device for the production of an electron beam with high surface strengths. The device has a cathode component with a convex cathode face with a predetermined radius for extracting the electron beam in such an alignment that a magnetic field or the magnetic field lines thereof, for causing the extraction of the electron beam, is almost collinearly to the convex cathode face.

5 Claims, 1 Drawing Sheet

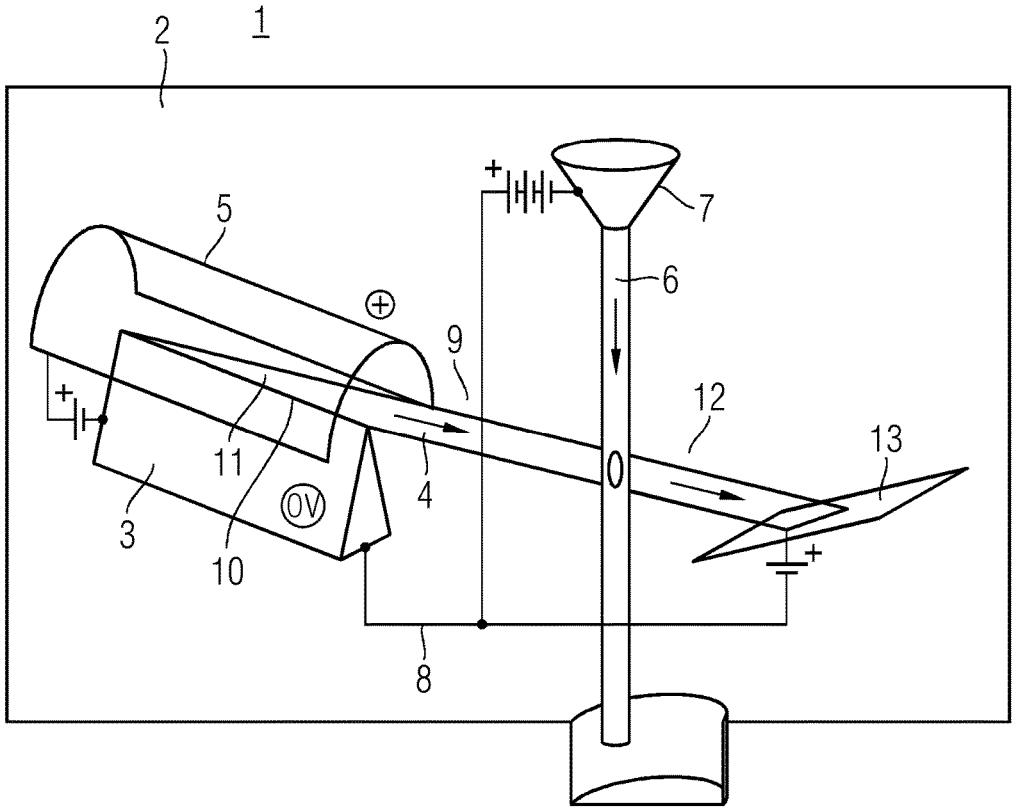
1
2
5
7
6
9
12
13
11
4
3
10
8
0V

DEVICE FOR PRODUCING AN ELECTRON BEAM

CROSS-REFERENCE TO RELATED APPLICATIONS

This application claims the benefit of DE 10 2014 226 812.5, filed on Dec. 22, 2014, which is hereby incorporated by reference in its entirety.

TECHNICAL FIELD

Embodiments relate to a device for producing an electron beam.

BACKGROUND

Electron beams with a high beam density are typically obtained from a large-area cathode by way of electrostatic focusing. An example for this is the well-known Pierce gun.

SUMMARY AND DESCRIPTION

The scope of the present invention is defined solely by the appended claims and is not affected to any degree by the statements within this summary. The present embodiments may obviate one or more of the drawbacks or limitations in the related art.

In an embodiment, a cathode face is concave and therefore the cathode face has a relatively low electric field strength, i.e. a relatively low maximum current density. In respect of cold cathodes, the necessary surface field strengths may only be achieved with difficulties in this manner.

Therefore, proceeding from a device of the type set forth at the outset, it is an object of the present embodiments to improve the cathode face such that surface field strengths are thus achieved.

According thereto, the device for producing an electron beam has, in particular, a cathode component with a cathode face used to extract the electron beam. The cathode face has a convex embodiment with a predetermined radius. Furthermore, a provision for causing the extraction of the electron beam by the cathode component is formed by an extraction electrode. The extraction electrode is concentric to the convex cathode face and has a larger radius, and a magnetic field extending almost collinearly to the convex cathode face is arranged to cause the extraction of the electron beam.

Electron beams with a high density are producible thereby in a simple manner. An emission-limiting space charge effect may be reduced because the effective electric field perpendicular to the convex cathode face may be selected to be very high as a disruptive discharge to the concentric extraction electrode is suppressed by the magnetic field present.

Overall, what is proposed in the cathode component is the use of a convex cathode face for extracting the electron beam with a concentrically surrounding extraction electrode, wherein the alignment of the convex cathode face is selected in such a way that the alignment is slightly inclined in relation to the field lines of a strong homogeneous magnetic field. A very high field strength at the cathode enables high emission current densities, since a disruptive discharge to the extraction electrode is suppressed by the magnetic field.

The convex cathode face is embodied in the form of an edge or a needle, which may be arranged with a slight inclination in relation to the field lines of a strong homogeneous magnetic field.

In a further embodiment, the cathode component is embodied as a knife-edge cathode with a cathode edge arranged in such a way that a small edge/magnetic flux line angle is formed between the cathode edge and the magnetic flux lines of the magnetic field causing the extraction of the electron beam. In this case, the cathode edge forms the convex cathode face. As a result of the aforementioned measures, an electron beam, which is a type of flat electron beam in the cross section thereof, is produced in the direction of the anode.

BRIEF DESCRIPTION OF THE DRAWINGS

FIG. 1 depicts an embodiment of a metal jet x-ray tube.

DETAILED DESCRIPTION

FIG. 1 depicts a metal jet x-ray tube 1. The metal jet x-ray tube 1 has a vacuum chamber 2 in which a cathode component 3 is arranged. The cathode component 3 serves to extract an electron beam 4. An extraction electrode 5 configured for causing the extraction of the electron beam 4 from the cathode component 3 is provided in the vacuum chamber 2. In the vacuum chamber 2 is located an anode component 7 formed with a liquid metal jet 6. The metal jet 6 is the target for the emitted electron beam 4 of the cathode component 3. An accelerator 8 serves for accelerating the electron beam 4 emitted by the cathode component 3 in the direction and with the target of the anode component 7, at least within a vacuum path 9.

In an embodiment, the metal jet 6 is realized as a thin metal jet, to the extent that the electrons of the electron beam 4 are, for example, only partly decelerated by the metal jet 6.

The cathode component 3 has a cathode knife edge 10 such that the cathode component 3 may also be referred to as a knife-edge cathode. The cathode knife edge 10 serves as convex cathode face for extracting the electron beam 4. The convexity of the convex cathode face is set by a predetermined radius. The cathode knife edge may also be realized with the aid of a needle-like embodiment. The cathode knife edge is aligned with a slight downward inclination in the direction of the liquid metal jet 6 of the anode component 7. In relation to this alignment, the magnetic field, extending in relation to the convex cathode face, for causing the extraction of the electron beam is arranged almost collinearly. A small edge/magnetic flux line angle 11 exists between this convex cathode face and the magnetic flux lines of the magnetic field causing the extraction of the electron beam.

In order to complete the description, FIG. 1 also shows a further vacuum path 12 downstream of the anode component 7 for the electrons of the electron beam 4 that may not yet have been decelerated completely. The vacuum path 12 serves to decelerate the possibly only partly decelerated electrons downstream of the anode component 7, at least approximately to standstill. An embodiment in accordance with FIG. 1 additionally has an energy recuperation provision 13.

It is to be understood that the elements and features recited in the appended claims may be combined in different ways to produce new claims that likewise fall within the scope of the present invention. Thus, whereas the dependent claims appended below depend from only a single independent or dependent claim, it is to be understood that these dependent claims may, alternatively, be made to depend in the alternative from any preceding or following claim, whether independent or dependent, and that such new combinations are to be understood as forming a part of the present specification.

While the present invention has been described above by reference to various embodiments, it may be understood that many changes and modifications may be made to the described embodiments. It is therefore intended that the foregoing description be regarded as illustrative rather than limiting, and that it be understood that all equivalents and/or combinations of embodiments are intended to be included in this description.

The invention claimed is:

1. A device comprising:

a cathode component in a vacuum chamber and configured for emitting an electron beam;

an extraction electrode configured for extraction of the electron beam from the cathode component, an anode component configured as a target for the electron beam of the cathode component; and an accelerator configured for accelerating the electron beam emitted by the cathode component, within a vacuum path in a direction and with the target of the anode component;

wherein a convex cathode face of the cathode component is configured to extract the electron beam;

wherein the extraction electrode has a greater radius and is concentric around a length of the convex cathode face; wherein a magnetic field extending collinearly with the length of the convex cathode face is configured for the extraction of the electron beam.

2. The device of claim 1, wherein the convex cathode face has the form of an edge.

3. The device of claim 1, wherein the cathode component is a knife-edge cathode with a cathode edge along the length of the convex cathode face configured such that a small edge/magnetic flux line angle is formed between the cathode edge and one or more magnetic flux lines of the magnetic field causing the extraction of the electron beam.

4. The device of claim 2, wherein the cathode component is a knife-edge cathode with the edge configured such that a small edge/magnetic flux line angle is formed between the edge and one or more magnetic flux lines of the magnetic field causing the extraction of the electron beam.

5. The device of claim 1, wherein the length of the convex cathode face is parallel to the direction of the anode component.

* * * * *